US006233879B1

(12) United States Patent
Barbeau

(10) Patent No.: US 6,233,879 B1
(45) Date of Patent: May 22, 2001

(54) DOUBLE PIVOTABLE DOOR

(75) Inventor: Jean Barbeau, Otterburn Park (CA)

(73) Assignee: Groupe Pro-Plus Inc., Quebec (CA)

( * ) Notice: Subject to any disclaimer, the term of this patent is extended or adjusted under 35 U.S.C. 154(b) by 0 days.

(21) Appl. No.: 09/393,308

(22) Filed: Sep. 10, 1999

(51) Int. Cl.[7] ..... E05D 7/08; E05D 15/50; E05D 11/10; E06B 1/00

(52) U.S. Cl. ..... 52/71; 49/192; 49/193; 49/388; 49/392; 16/312; 16/317; 16/331; 16/332; 16/334

(58) Field of Search ..... 52/71, 204.1; 49/192, 49/193, 352, 388, 392; 16/332, 334, 312, 317

(56) References Cited

U.S. PATENT DOCUMENTS

| | | | | |
|---|---|---|---|---|
| 1,647,074 | * | 10/1927 | Bock | 49/193 X |
| 2,503,081 | * | 4/1950 | Teruya et al. | 49/388 X |
| 2,735,134 | * | 2/1956 | Green et al. | 16/331 X |
| 2,750,015 | * | 6/1956 | Hauck | 49/392 |
| 3,122,799 | * | 3/1964 | Lunde | 49/392 X |
| 3,628,845 | * | 12/1971 | Grimm | 16/312 X |
| 3,645,053 | * | 2/1972 | Taggart | 52/71 X |
| 3,722,031 | * | 3/1973 | Bourgeois | 16/317 |
| 4,063,585 | | 12/1977 | Stanley | 160/135 |
| 4,070,795 | * | 1/1978 | Lussier | 49/392 X |
| 4,491,355 | * | 1/1985 | Marinoni | 16/332 X |
| 4,596,062 | * | 6/1986 | Rock | 16/332 X |
| 4,821,788 | | 4/1989 | Nelson | 160/135 |
| 4,875,312 | * | 10/1989 | Schwartz | 49/388 X |
| 5,287,596 | * | 2/1994 | Chen et al. | 16/332 X |
| 5,364,311 | | 11/1994 | Chou | 472/62 |
| 5,365,706 | * | 11/1994 | Elsenpeter et al. | 52/204.1 |
| 5,367,745 | * | 11/1994 | Roloff | 16/312 |
| 5,417,021 | | 5/1995 | Tavshanjian | 52/243.1 |
| 5,450,694 | | 9/1995 | Goranson et al. | 52/71 |
| 5,515,899 | | 5/1996 | Chan | 160/135 |
| 5,535,550 | * | 7/1996 | Yang | 49/192 X |
| 5,875,594 | | 3/1999 | Hellwig et al. | 52/220.7 |
| 5,881,789 | | 3/1999 | Melashenko et al. | 160/135 |
| 5,901,415 | * | 5/1999 | Morrison et al. | 16/334 X |
| 5,915,441 | * | 6/1999 | Schlack | 16/334 X |

FOREIGN PATENT DOCUMENTS

| | | | | |
|---|---|---|---|---|
| 526747 | * | 3/1954 | (BE) | 49/192 |
| 636135 | * | 8/1963 | (BE) | 49/192 |
| 2095470 | | 12/1993 | (CA) . | |
| 2162300 | | 5/1997 | (CA) . | |
| 2178379 | | 12/1997 | (CA) . | |
| 1213290 | * | 3/1966 | (DE) | 49/192 |

* cited by examiner

*Primary Examiner*—Peter M. Cuomo
*Assistant Examiner*—Rodney B. White
(74) *Attorney, Agent, or Firm*—Nixon & Vanderhye P.C.

(57) ABSTRACT

A double pivotable door, particularly for use with modular office partitions is disclosed. The double pivotable door includes a frame, which is mounted to a partition by at least one hinge having a first axis of rotation. The frame include a door which is mounted to the frame and can rotate about a second axis of rotation, where the second axis of rotation is parallel but spaced from the first axis of rotation. The door can thus be mounted to partitions where there is limited space, and can rotate about the first axis, as a typical door, or rotate about the first and second axes simultaneously, thereby reducing by approximately half the clearance required for opening and closing the door. Preferably, the door includes a mechanism to prevent the door from pivoting about the second axis. Also preferably, the handle for the door is integral therewith.

17 Claims, 8 Drawing Sheets

FIG. 4
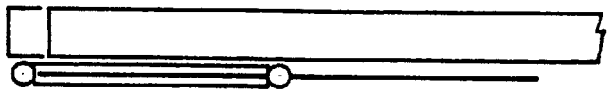
FIG. 5
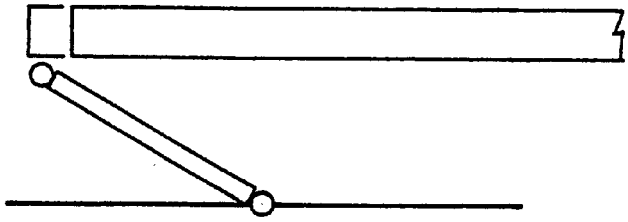
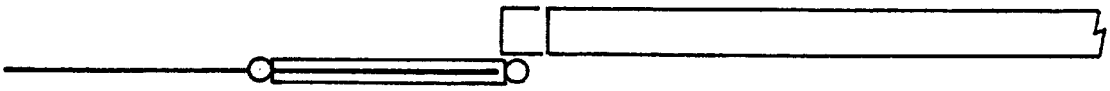
FIG. 6

DOUBLE PIVOTABLE DOOR

FIELD OF THE INVENTION

The present invention relates to a door which can open and close about two separate axes. The present invention is more particularly adapted for use with modular partitions typically used to subdivide an open space into a plurality of smaller spaces, such as those found in offices.

DESCRIPTION OF THE PRIOR ART

It is well known to use modular partitions to subdivide an open space into a plurality of smaller spaces, particularly in the context of organising office space. Such partitions offer great flexibility in order to respond to the changing needs of a user. The partitions are interconnected to form "offices", and can be adapted to support work surfaces, to include windows and accessories, etc.

Conventional integrated partition systems also include conventional doors in order to close one or more "offices", and to provide a high level of privacy. However, the use of conventional doors has a number of drawbacks, such as requiring space to provide clearance for the opening and closing of the door; requiring a fixed frame separate from the partitions and mechanically fastened thereto; and requiring manual adjustment.

Canadian patent application number 2.178.379 describes a privacy screen for office panelling systems, where the screen is telescopically mounted to one panel of the system. However, such a system must be installed on the outside of the panel, thereby encroaching into a hallway.

SUMMARY OF THE INVENTION

It is an object of the invention to provide a door which can be installed in relatively small spaces, which does not require a large radius for clearance, is easy to install and does not require undue adjustment.

In accordance with the invention, this object is achieved with a double pivotable door comprising a frame including means for pivotally mounting said frame to a structure about a first axis, said frame including a top arm and a bottom arm; and a door pivotally mounted to said top and bottom arms of said frame about a second axis.

BRIEF DESCRIPTION OF THE DRAWINGS

The present invention and its advantages will be more easily understood after reading the following non-restrictive description of preferred embodiments thereof, made with reference to the following drawings in which:

FIGS. 4, 5 and 6 are top plan views of the double pivotable door according to a preferred embodiment of the invention in open, opening and closed positions;

DESCRIPTION OF A PREFERRED EMBODIMENT OF THE INVENTION

As mentioned previously, the present invention is directed to a double pivotable door which is particularly useful in the context of modular partitions, but could also be used in a variety of other contexts where a light door offering a medium degree of privacy is required. The present invention is thus an alternative to a conventional door.

Figure 1:
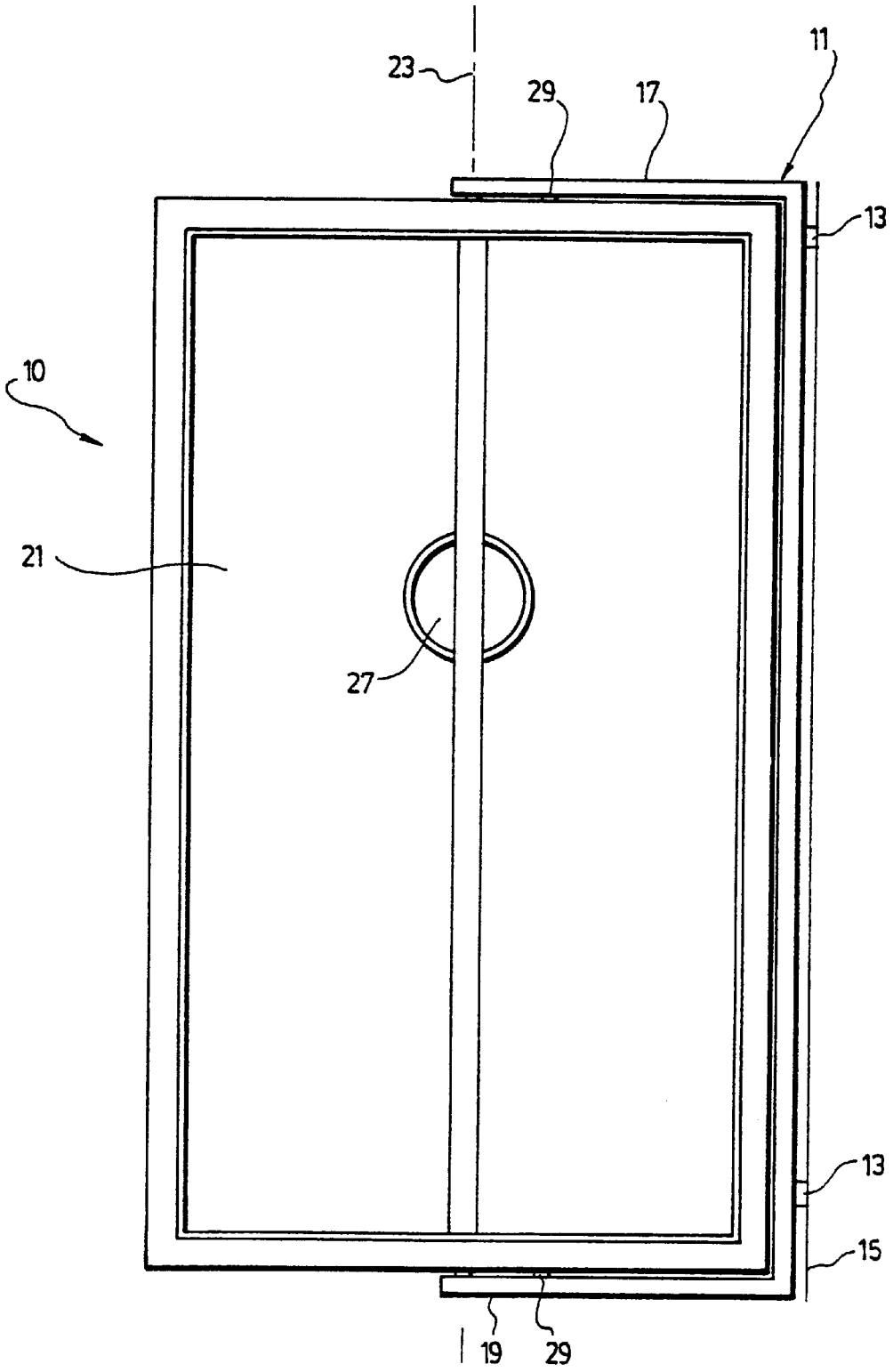
FIG. 1 is a front elevational view of a double partition door according to a preferred embodiment of the invention.

The double pivotable door 10 according to the invention comprises a frame 11 including means 13 for pivotally mounting said frame 11 to a structure about a first axis 15. The frame 11 includes a top arm 17 and a bottom arm 19. The double pivotable door also includes a door 21 (or door panel) pivotally mounted to the top 17 and bottom 19 arms of the frame 11 about a second axis 23. Preferably, as shown in FIG. 1, the frame 11 is a C-shaped frame. Since the door 21 pivots about axis 23, the length of the arms 17 and 19 must be slightly longer than half the width of the door 21 so that the frame 11 does not interfere with the door 21 when it pivots about axis 23.

Figure 16:
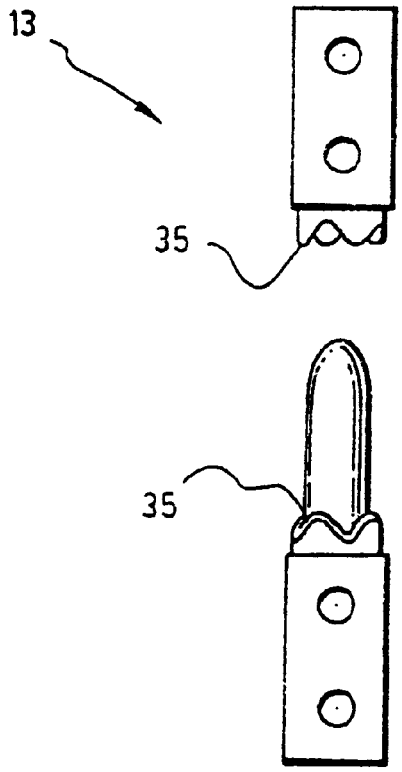
FIG. 16 is an exploded view of a lift-off hinge for use with the double pivotable door according to a preferred embodiment of the invention.

Preferably, the means 13 for pivotally mounting the frame 11 to a structure includes at least one, but preferably two, hinge means 13. In a preferred embodiment of the invention, the hinge means 13 are lift-off hinges as those shown in FIG. 16 and commercially available, and preferably the lift-off hinges are provided with stops 35 for blocking the pivotal movement of the frame 11 at 0, 90 and 180 degrees. Further advantageously, the hinge means 13 are located proximate the top and bottom arms of the C-shaped frame 11.

Since the door 21 is pivotally mounted to the arms 17, 19 of the frame 11, it can pivot about axis 23. Also, the frame itself may pivot about axis 15. Consequently, in distinction with a conventional door, the double pivotable door of the present invention does not have a fixed frame fastened to a floor, and is not mechanically fastened on both sides of the door. Thus, the pivot radius is approximately halved by virtue of the axis 23. The movement of the double pivotable door 10 of the invention about axes 15 and 23 (in this case simultaneously) is illustrated in FIGS. 4, 5 and 6, where FIG. 4 shows the door in open position, FIG. 5 shows the door in closing (or opening) position and FIG. 6 shows the door in closed position. This permits the mounting of the double pivotable door of the invention in restricted space, either in corridors adjacent to panel walls or inside where visitor's chairs and office furniture are located. This is particularly advantageous since there is a tendency in modular office panelling to decrease the size allocated to a given office. The present invention is an elegant solution to the problem of lack of space.

Figure 2:
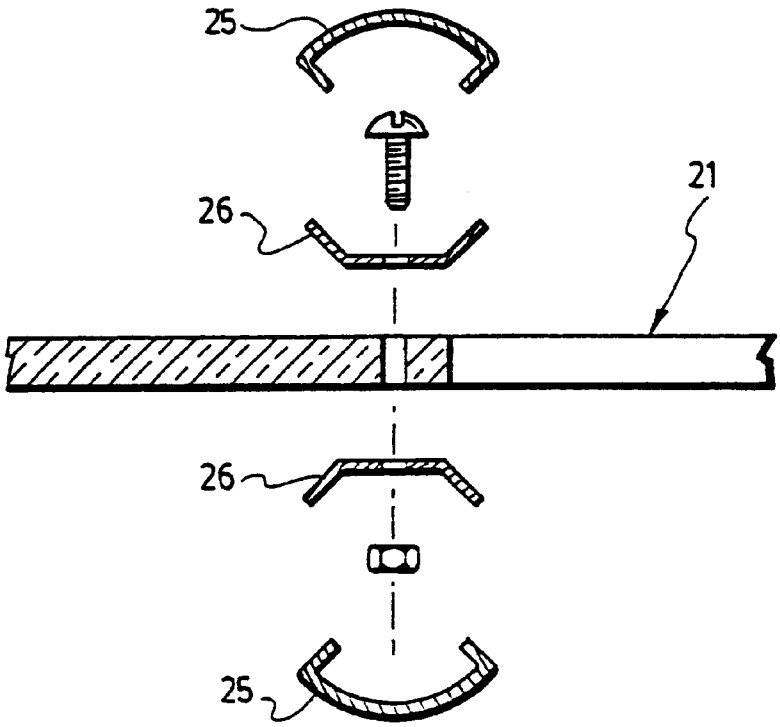
FIG. 2 is a top exploded view of a handle assembly for the double pivotable door of the invention.
Figure 3:
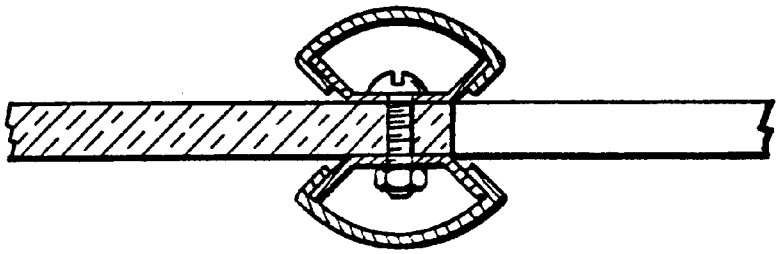
FIG. 3 is a top assembled view of the handle assembly of FIG. 2.

It should also be noted that the door is very thin. As shown in FIGS. 2 and 3, the handle 25 is preferably integrated to the door by way of a "corniere" 26 which is maintained in position with a nut and bolt assembly. Consequently, the door is provided with an opening 27 to permit a user to grip the handle 25 with one hand. Further preferably, the handle is coaxial with axis 23. However, the integration of the handle to the door is not an essential requirement of the invention.

Figure 15:
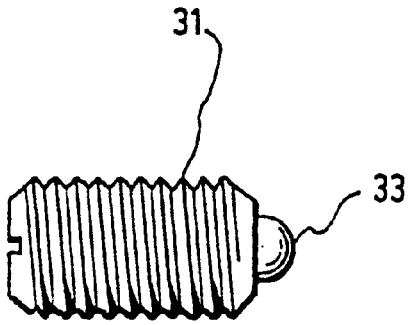
FIG. 15 is a side view of a spring loaded plunger for use with the double pivotable door according to a preferred embodiment of the invention.

In a preferred embodiment of the invention, the door 21 can be prevented from pivoting about axis 23 by using locking means 29. Advantageously, the locking means are a spring loaded plunger 29, shown in FIG. 15, also commercially available. The fixed part 31 of the plunger 29 is fastened to one of the top and bottom arms 17, 19, or both, and the movable part 33 of the plunger 29 engages a longitudinal groove in the top or bottom of the door 21. In such a case, the door would open and close as a traditional door about axis 15. However, it should be understood that the plunger can engage any other part of the door or the frame. More specifically, the door 21 can be spaced from the arms 17, 19 by the use of spacers (not shown). These spacers could further be advantageously elongated toward the hinge means by a distance slightly longer than the distance between axis 23 and the locking means 29. In such a case, the spacers could be further provided with a groove to receive the movable part 33 of the plunger 29 and to lock the same therein.

Figure 7:
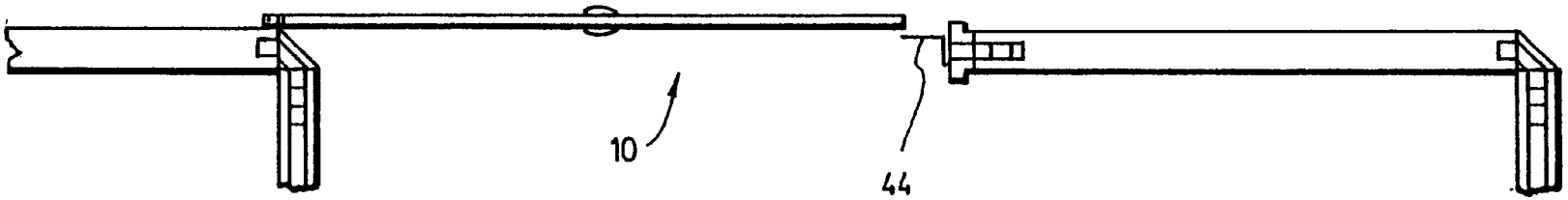
FIGS. 7 to 14 are top plan views of the double pivotable door mounted in a variety of fashions on a partition, in open and closed positions.
Figure 8:
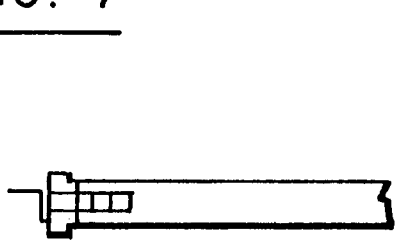
Figure 8:
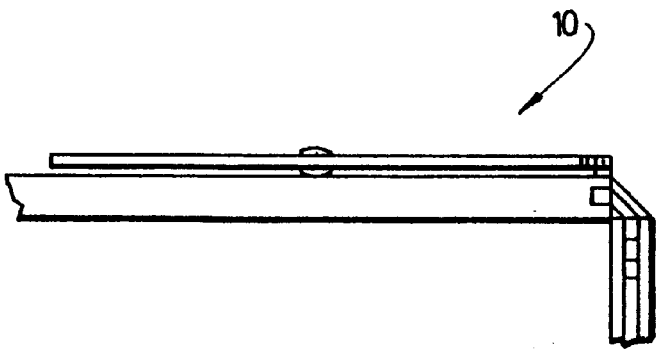
Figure 9:
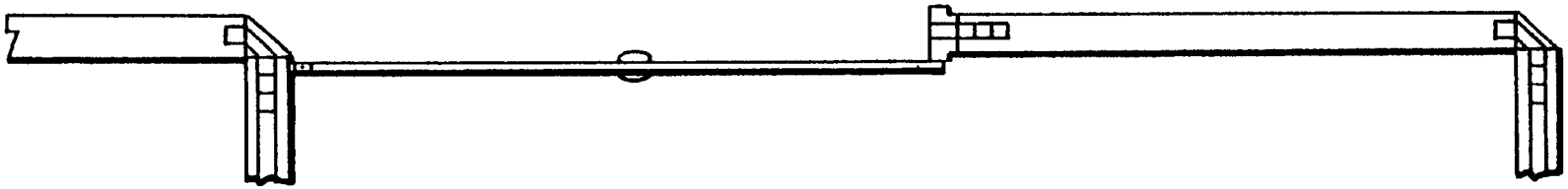
Figure 10:
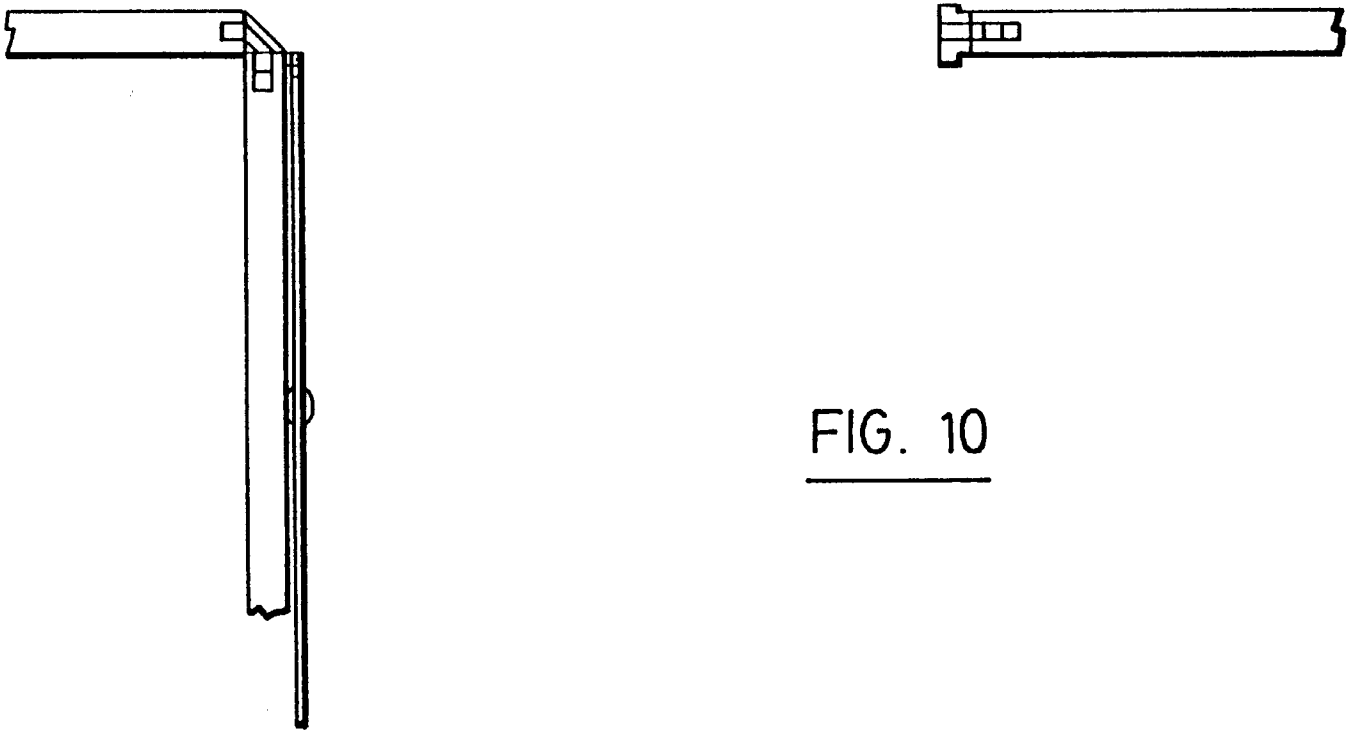
Figure 11:
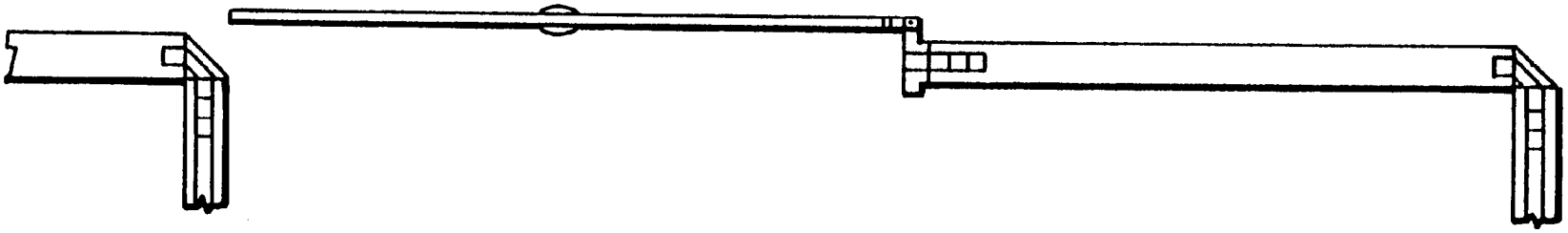
Figure 12:
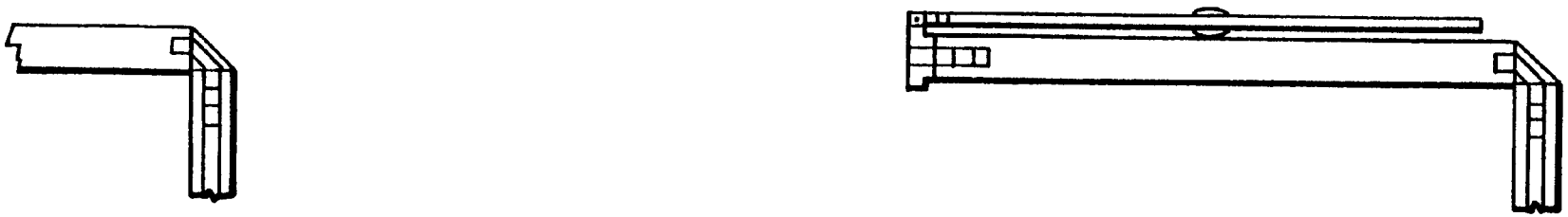
Figure 13:
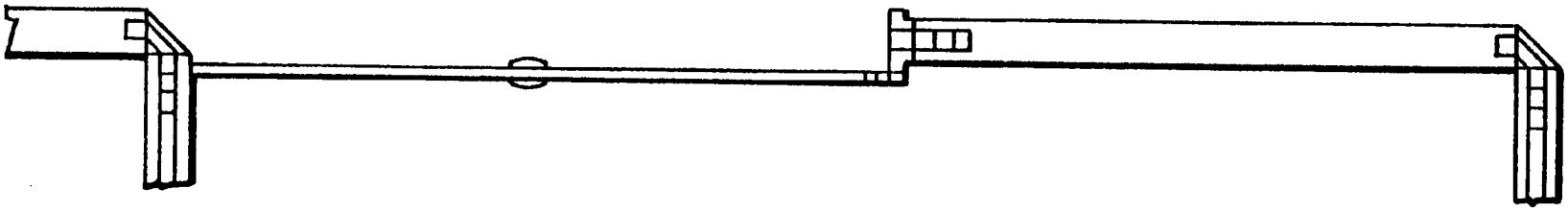
Figure 14:
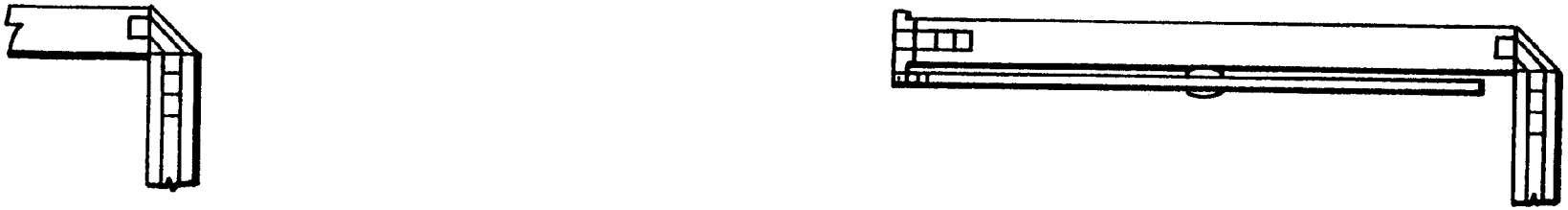

Since the double pivotable door 10 of the invention is mounted only on one side (i.e. the vertical portion of the C-shaped frame), it can be mounted almost anywhere without difficulty. Illustrations of such mountings are shown in FIGS. 7–14. FIGS. 7 and 8 show the door mounted on the outside corner of a panel in closed and open positions, respectively. In such a case, it is preferable for a catch 44 to be mounted opposite the C-shaped frame in order to hide the space left between the door and the panel. FIGS. 9 and 10 show the door mounted to the inside corner of a panel in closed and open positions respectively. FIGS. 11 and 12 show the door mounted on an outside end of a panel in closed and open positions respectively. FIGS. 13 and 14 show the door mounted on an inside end of a panel in closed and open positions respectively. Thus, the double pivotable door of the present invention is extremely versatile in that it can be installed almost anywhere. It should be understood by a person skilled in the art that the present invention is not limited to a double pivotable door for use exclusively with modular office panelling, but can easily be installed to any structure where space is limited and a medium degree of privacy is required.

Since the door of the present invention is only mounted on one side, and since there is no fixed frame on both sides of the door, it is difficult to provide means to lock the door in the closed position, but such a possibility is not excluded by the invention.

The double pivotable door according to the present invention reduces the quantity of raw material required, since it is preferably made of fluted polycarbonate which allows light to pass but prevents somebody from looking through the door. It should be understood however that other materials could be used depending on the degree of privacy required, or for aesthetic purposes. The double pivotable door of the present invention does not require fastidious adjustment.

The purpose of the invention is to provide the occupant of an office with a certain degree of visual privacy. It can thus be referred to as a light door, given its thinness and the degree of privacy it procures.

Although the present invention has been explained hereinabove by way of a preferred embodiment thereof, it should be pointed out that any modifications to this preferred embodiment within the scope of the appended claims is not deemed to alter of change the nature and scope of the present invention.

What is claimed is:

1. A double pivotable door comprising:

a frame pivotally mounted to a structure about a first axis, said frame including a top arm and a bottom arm; and a door pivotally mounted to said top and bottom arms of said frame about a second axis, wherein said top and bottom arms have a length less than the width of said door, and wherein each of said top and bottom arms have an end, each of said ends being pivotally connected to said door about said second axis.

2. A double pivotable door according to claim 1, wherein said frame is a C-shaped frame.

3. A double pivotable door according to claim 1, wherein said means for pivotally mounting said frame to a structure is at least one lift-off hinge.

4. A double pivotable door according to claim 3, wherein said means for pivotally mounting said frame to a structure includes two lift-off hinges.

5. A double pivotable door according to claim 4, wherein said lift-off hinges further include cam stops at 0°, 90° and 180°.

6. A double pivotable door according to claim 1, wherein said second axis is substantially coincident with a central longitudinal axis of said door.

7. A double pivotable door according to claim 1, wherein said door further includes releasable locking means for preventing said door from pivoting about said second axis.

8. A double pivotable door according to claim 7, wherein said releasable locking means for preventing said door from pivoting about said second axis include a spring loaded plunger mounted on one of said first and second arms, and a groove on said door in registration with said plunger for receiving the same when said door is locked about its second axis.

9. A double pivotable door according to claim 1, wherein said door is provided with an integral handle.

10. A double pivotable door for use with a system of modular panels subdividing an open space into a plurality of smaller spaces, where at least some of the smaller spaces have an entryway, said pivotable door comprising:

a frame pivotally mounted to a panel about a first axis, said frame including a top arm and a bottom arm; and a door pivotally mounted to said top and bottom arms of said frame about a second axis, wherein said top and bottom arms have a length less than the width of said door, and wherein each of said top and bottom arms have an end, each of said ends being pivotally connected to said door about said second axis.

11. A double pivotable door according to claim 10, wherein said frame is a C-shaped frame.

12. A double pivotable door according to claim 10, wherein said means for pivotally mounting said frame to a structure is at least one lift-off hinge.

13. A double pivotable door according to claim 12, wherein said means for pivotally mounting said frame to a structure includes two lift-off hinges.

14. A double pivotable door according to claim 13, wherein said lift-off hinges further include cam stops at 0°, 90° and 180°.

15. A double pivotable door according to claim 10, wherein said second axis is substantially coincident with a central longitudinal axis of said door.

16. A double pivotable door according to claim 10, wherein said door further includes releasable locking means for preventing said door from pivoting about said second axis.

17. A double pivotable door according to claim 16, wherein said releasable locking means for preventing said door from pivoting about said second axis include a spring loaded plunger mounted on one of said first and second arms, and a groove on said door in registration with said plunger for receiving the same when said door is locked about its second axis.

* * * * *